219-121
3/16/76 XR 3,944,412 SR

United States Patent [19]
Liu

[11] 3,944,412
[45] Mar. 16, 1976

[54] METHOD FOR RECOVERING METALS

[76] Inventor: Hsin Liu, 40-25 Hampton St., Elmhurst, N.Y. 11373

[22] Filed: Sept. 18, 1974

[21] Appl. No.: 507,153

[52] U.S. Cl. ..... 75/10 R; 13/9 R; 219/121 P
[51] Int. Cl.[2] ..... C22D 7/00
[58] Field of Search ..... 75/10 R; 13/9; 219/121 P

[56] References Cited

UNITED STATES PATENTS

| | | | |
|---|---|---|---|
| 3,588,594 | 6/1971 | Yamamoto et al. | 219/121 P |
| 3,749,803 | 7/1973 | Camacho | 13/9 |
| 3,779,182 | 12/1973 | Camacho | 219/121 P |
| 3,843,352 | 10/1974 | Ulrich | 75/10 R |
| 3,852,061 | 12/1974 | Wulff | 75/10 R |

*Primary Examiner*—M. J. Andrews
*Attorney, Agent, or Firm*—Kenyon & Kenyon Reilly Carr & Chapin

[57] ABSTRACT

The disclosure relates to a method and apparatus for recycling, smelting, and refining waste metal material and low grade metal material. A magneto-plasma provides a high temperature for extracting metals. The magneto-plasma is comprised of an alternating current plasma superimposed upon a direct current plasma with the plasmas being confined by an externally applied axial magnetic field. The magneto-plasma is sustained with reduced voltage fluctuations across the plasma even when the background gas of the plasma is contaminated by the products from the smelting operation. The metal material being smelted is caused to melt by the high temperatures within the magneto-plasma which can be in the range of 10,000° K. The metal material upon being melted into droplets is exposed to the high temperature of the magneto-plasma for a predetermined period of time as the droplets descend through the plasma. The length of the magneto-plasma is adjusted to obtain refining of the droplets of molten metal within th plasma. In addition, the lateral cross section of the length of the magneto-plasma is adjusted to enhance refining of the molten droplets.

7 Claims, 8 Drawing Figures

METHOD FOR RECOVERING METALS

BACKGROUND OF THE INVENTION

1. Field of the Invention

The invention pertains to the field of the generation of a plasma which is a highly ionized gas. More in particular, the invention pertains to the use of a plasma as a heat source in the smelting and refining of metal material. The field of the invention includes the apparatus and the method of producing a plasma by the co-action of alternating current and direct current electric fields in the presence of an externally applied axial magnetic field. As referred to herein, the invention pertains to a method and apparatus for generating a magneto-plasma.

The fields of arts to which the invention pertains also includes a method and apparatus for smelting and refining metal material during passage of the material through a magneto-plasma. The field of the invention also includes the control of the length and lateral cross-section of the magneto-plasma as well as the stable operating conditions of input power and temperature.

2. Description of the Prior Art

Throughtout the history of the metal producing and fabricating industries, attempts have been made to recover metal from scrap material. The two major types of scrap metal material are revert scrap and purchased commercial grade scrap. Revert scrap material is scrap which unavoidably results from metal-making and finishing operations. Purchased commercial grade scrap includes prompt industrial scrap and dormant scrap. Industrial scrap which is a by-product of metal fabricating and forming industries in manufacturing their products comprises prompt industrial scrap. Dormant scrap comprises obsolete, worn-out, or broken products of consuming industries. Revert scrap and prompt industrial scrap can usually be identified easily as to source and composition and thus it is more valuable for metal recovery. Dormant scrap requires careful sorting and classification to prevent the contamination of metal in the furnace with unwanted chemical elements from alloys that may be present in such scrap.

When the chemical compositions of scrap is known, the scrap can prove to be a valuable source of alloying elements needed in the steel industry for the production of alloy steels. Full advantage is taken of this source in the production of alloy steels in electric furnaces (electric arc, induction, etc.) as well as in the basic oxygen furnace and the open-hearth furnace, because the preponderance of production consists of carbon and low-alloy steels.

Unidentified alloying elements in scrap can be a source of trouble. Tin, copper, nickel and other elements present in scrap can alloy readily with steel and, in many instances render it unfit for its intended use. Relatively small amounts of these metals can contaminate an entire heat of steel. Tin and copper in certain amounts can cause brittleness and bad surface conditions in steel. Nickel and tin not only contaminate heats into which they may be unintentionally introduced, but may deposit a residue in the furnace that is absorbed by successive heats with resultant contamination. Lead is extremely harmful to furnace bottoms and refractories, and if present in sufficient quantities, may cause the furnace to fail by penetrating joints or cracks in the bottom to form channels through which molten steel may flow. Therefore, even with purchased clean commercial grade metal scrap, it is extremely important that it be sorted before being used.

Metal scrap may be that separated from solid waste material. Due to the miscellaneous nature of solid waste material, a large percentage of it is of unknown origin and composition. It is obviously uneconomical and impractical to analyze chemically each individual piece of scrap in the huge amounts of metal scrap present in solid waste material. As a result up to now, it is the usual practice for the great majority of municipal governments to dump all metals with the solid waste material or refuse into a land fill. In certain instances there are relatively small projects which utilize combustible materials from solid-waste for supplemental fuel, and which separate scrap metal from the waste material as a product.

Scrap metal separated from solid-waste may present a difficult technological problem for the steel and aluminum industries. Such scrap metal materials are extremely contaminated by foreign materials on the surface. A cleaning process for removing the contaminants is expensive. In addition, the chemical composition of such scrap metal is unknown. Moreover, when the scrap includes steel containers another problem arises since tin-plated steel and tin are not acceptable in steel alloys. If the scrap includes aluminum containers, the lids of the containers are made from a different alloy than the bodies. Thus it can be seen that the utilization of this kind of scrap metal for electric-arc furnaces, induction furnaces, basic oxygen furnaces and open-hearth furnaces of the steel industry can be uneconomical and impractical. The same can be said for the aluminum industry. The lid and body may contain about 2.25 percent magnesium and 1 percent manganese on the average. Both elements are usually undesirable in secondary aluminum alloys. To remove magnesium and dilute the manganese content are costly. As a result, less than 2 percent of clean aluminum containers can be recycled today. Almost none of contaminated aluminum containers are being recycled today. Therefore, the utilization of this kind of scrap metal for electric-arc furnaces, induction furnaces, basic oxygen furnaces, open-hearth and aluminum alloy industry is uneconomical and impractical.

After a costly cleaning process, contaminated steel scrap in small quantities can be introduced into a blast furnace. Thus the blast furnace can utilize a small proportion of contaminated steel scrap in conjunction with approximately 93 percent or more of iron-bearing materials (i.e., iron ore) to produce pig iron or hot metals; however, there are limitations in utilizing this kind of steel scrap. Not only is a blast furnace limited to a small portion of scraps but also a blast furnace must be located near to a source of iron ore and coke. The required location of a blast furnace can therefore mean transportation expenses for handling scraps which can be prohibitive if the distances involved are outside of an appropriate one hundred mile radius of the blast furnace. Therefore, these limitations cause steel scrap separated from solid-waste to have a very low economic value where moderate distances to a blast furnace are involved and virtually no economic value where large distances are involved.

The prior art includes methods and apparatus for the use of an electric arc as well as a plasma in refining metal materials.

U.S. Pat. No. 3,546,348 which issued to Serafino M. Decorso on Dec. 8, 1970 discloses a vacuum furnace for purifying or refining metal materials when heated by an electric arc.

U.S. Pat. No. 3,201,560 which issued to R. F. Mayo et al on Aug. 17, 1965 discloses an arc discharge device for generating high temperature gas. The patent discloses the use of a high intensity magnetic field directed axially with respect to the chamber through which the arc region extends. The interaction between the electric field of the arc electrodes and the transverse magnetic field creates a force which is perpendicular to these vector quantities and which acts upon the current carriers of the arc. As a result, a curvilinear motion is imparted to the current carriers. The presence of the high intensity fields increases arc defusion and results in a positive effective resistance characteristic of the arc. This is in direct contrast to a normal arc which has a negative resistance characteristic.

U.S. Pat. No. 2,960,331 which issued to C. W. Hanks on Nov. 15, 1960 discloses the use of an electric arc in refining metal particles which are converted into molten droplets by the arc. The system operates within an evacuated chamber.

U.S. Pat. No. 3,429,691 which issued to W. J. McLaughlin on Feb. 25, 1969 discloses the use of a hydrogen plasma to reduce titanium dioxide to titanium metal by passing finely divided titanium dioxide particles through the plasma. A winding surrounding the plasma generator provides a magnetic field for controlling the plasma velocity.

U.S. Pat. No. 3,536,885 which issued to P. Mitchell on Oct. 27, 1970 discloses a plasma torch in which a pilot gas plasma is formed between direct current electrodes and the resulting plasma is directed to a plasma region extending between alternating current electrodes.

U.S. Pat. No. 3,248,513 which issued to J. A. F. Sunnen on Apr. 26, 1966 also shows a plasma device in which a plasma formed between direct current electrodes is extended to a region formed by alternating current electrodes.

SUMMARY OF THE INVENTION

In accordance with the invention, there is provided an economical and efficient process and apparatus for recycling, smelting and refining metal materials such as contaminated metals from solid waste materials or low grade metal materials such as sponge metals. Thus, the invention enables the recycling of metal materials which could not otherwise be recycled.

The invention includes a method and apparatus for generating a plasma formed by an alternating current plasma superimposed upon a direct current plasma with the plasma being confined by an externally applied axial magnetic field. The resulting plasma, which is described as a magneto-plasma, can be sustained with low voltage fluctuations which would otherwise occur due to the presence of contaminants within the background gas of the plasma.

The invention also relates to the control of the magneto-plasma in response to its characteristic by which the voltage-current characteristic of the plasma has a positive slope rather than the negative slope which is conventional for electric arc discharges. The positive slope characteristic of the magneto-plasma of the invention eliminates the need for large electrical reactances and complex feedback mechanisms for maintaining the plasma in a stabilized condition.

In accordance with the invention, the length and lateral extent of the column of the magneto-plasma can be controlled while maintaining the stabilization of the plasma. Accordingly, the dwell time period for the smelting and refining process which is the transit time of the metal droplets through the plasma column can be adjusted for an optimum operating condition.

In accordance with the invention the provision of an externally applied axially magnetic field to the plasma results in the electrons of the plasma transferring their energy to the incoming metal material to be smelted and the molten metal material with the result that the efficiency of the system is enhanced over that of known electric furnaces.

The invention also relates to the provision of a low level vacuum region in which the incoming material is received and heated to a predetermined temperature. As a result, the high level vacuum region can be confined to the area in which the magneto-plasma smelts the metal.

Thus it is an object of the invention to provide an economical and efficient method and apparatus for generating a plasma suitable for smelting and refining metal materials.

It is another object of the invention to provide a method and an apparatus for smelting and refining scrap metal including scrap metal separated from solid waste material.

It is still another object of the invention to provide a plasma comprising an alternating current plasma superimposed upon a direct current plasma.

It is a further object of the invention to control an alternating current plasma superimposed upon a direct current plasma by an axial magnetic field for enhancing the smelting and refining of metal material passing through the plasmas.

DESCRIPTION OF THE PREFERRED EMBODIMENT

Figure 1:
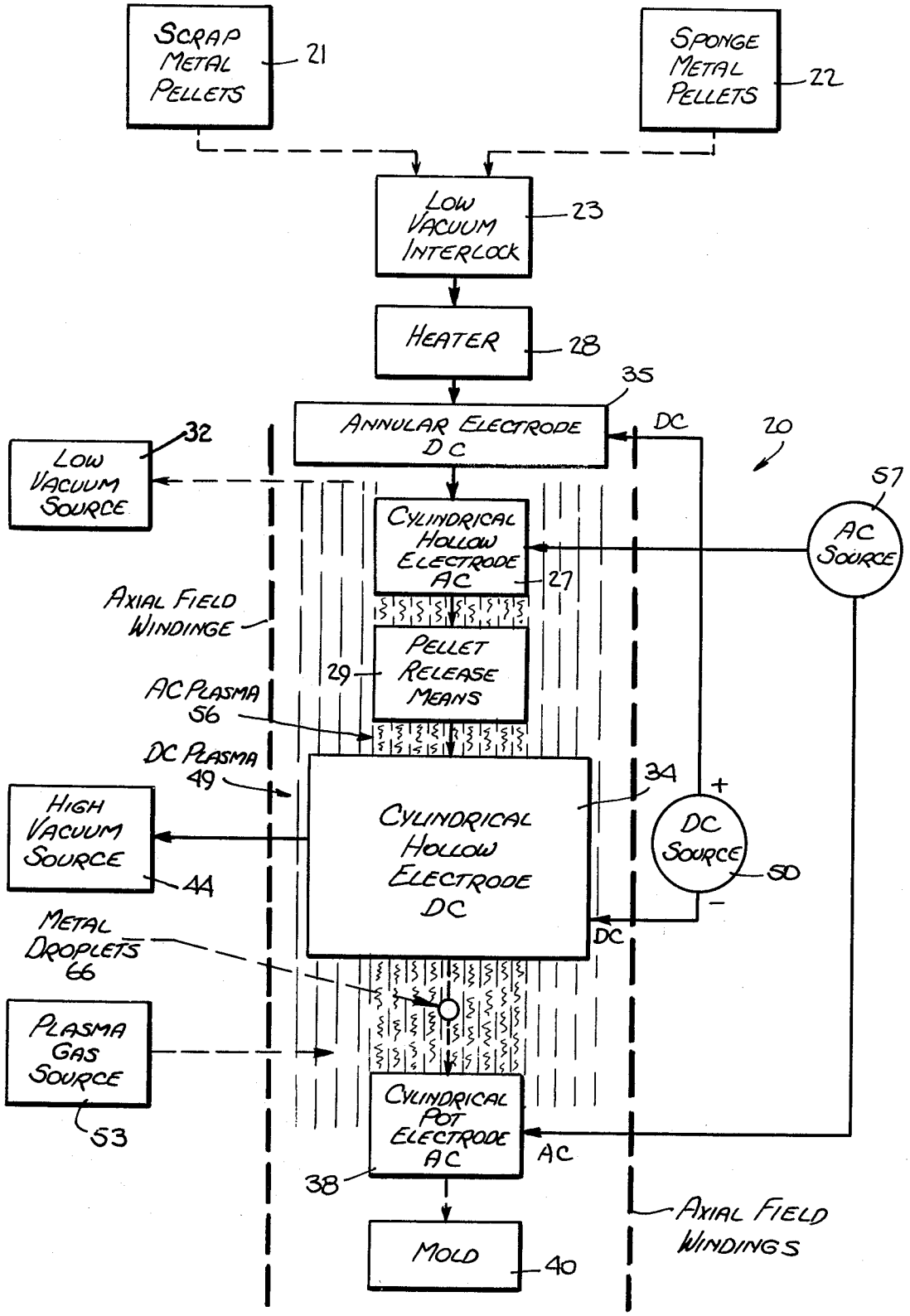
FIG. 1 is a block diagram of the method and apparatus of the invention for smelting and refining metal material.
Figure 2:
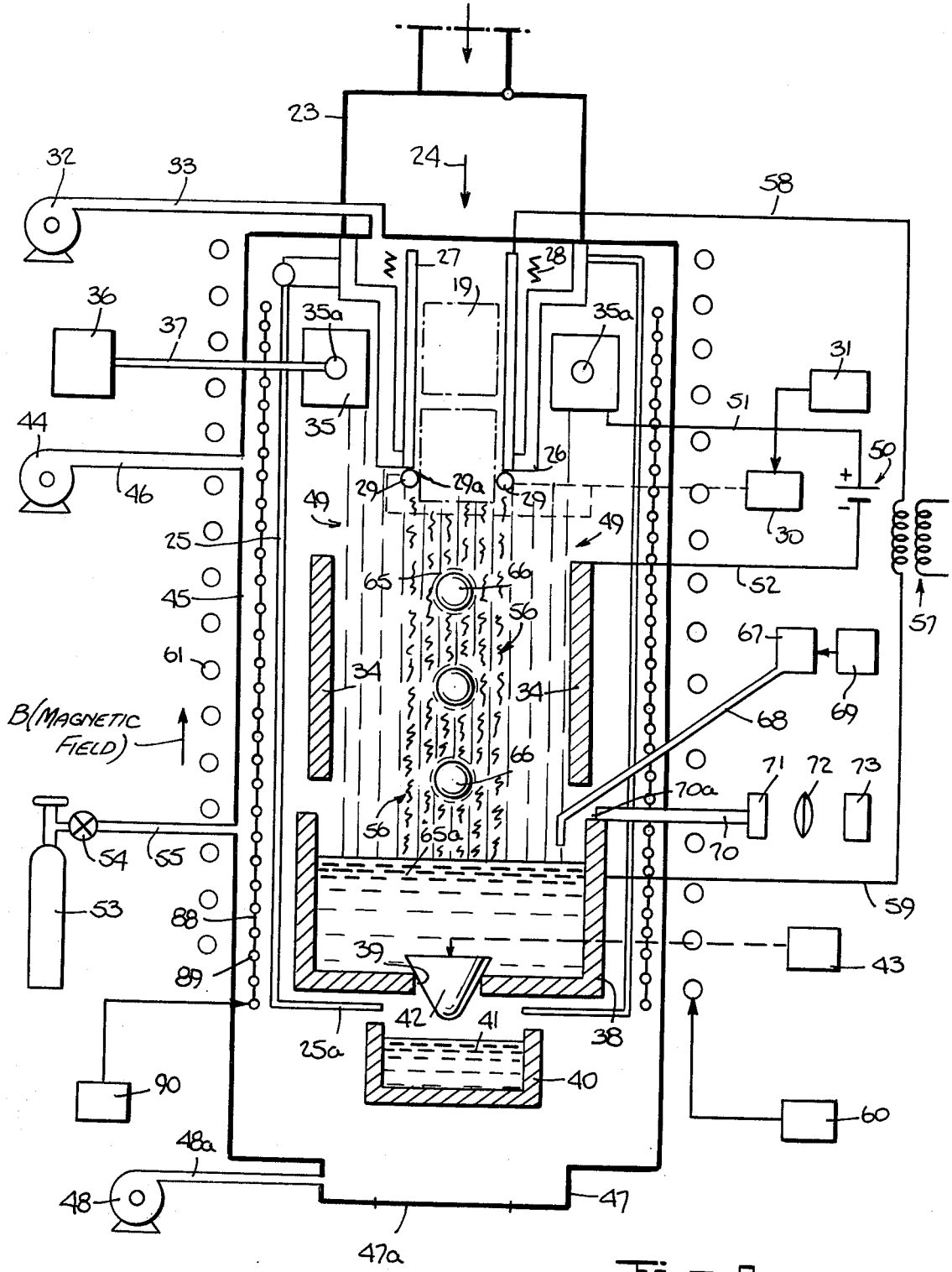
FIG. 2 is a schematic representation of the plasma furnace of the invention.
Figure 3:
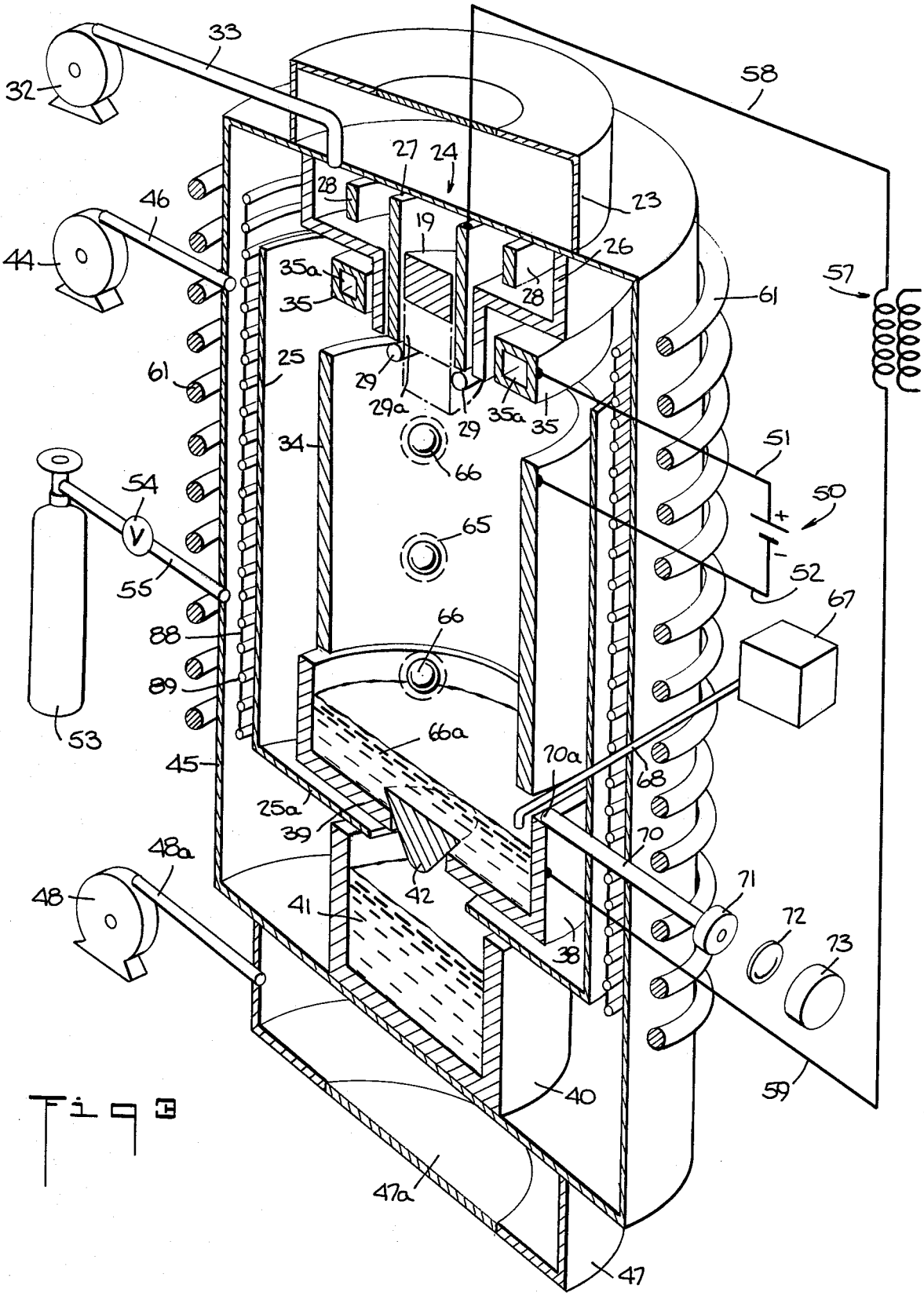
FIG. 3 is a cutaway perspective view of the plasma furnace.

As shown in FIGS. 1, 2 and 3, furnace 20 of the invention is adapted to receive scrap metal pellets 19 from source 21 or sponge metal pellets from source 22. The scrap metal pellets can include revert scrap resulting from metalmaking and finishing operations. Such scrap can be of known composition when its source of supply is known. The scrap may contain alloy materials such as tin, copper, nickel, etc.; however, furnace 20 of the invention is capable of eliminating the alloy materials during refining. Source 21 may also include prompt industrial scrap which is a by-product of metal consuming industries resulting from the fabrication of metal products. Source 21 can also include dormant scrap which is metal material comprising obsolete, worn-out or damaged metal products. Dormant scrap comprises a variety of different metal alloys; however, the furnace of the invention is capable of refining such scrap.

Source 22 provides sponge metal pellets for refining. Such pellets are obtained from the direct-reduction process of metal producing operations and, accordingly, are of known composition. Alloy constituents of sponge metal pellets can also be removed in the refining process of the invention.

Furnace 20 of the invention can refine metal scrap which has been separated from solid waste material. Such scrap comprises a plurality of different alloys of a given metal along with contaminants related to the solid waste from which the scrap has been extracted. Metal scrap separated from solid waste material can include aluminum containers in which the aluminum alloy for the lid can be quite different from the alloy forming the body of the container. For example, the aluminum alloys may contain magnesium in the range of about 2.25 percent and and manganese in the range of about 1 percent. Furnace 20 of the invention can remove these alloy materials in the refining process of the invention.

The pellets 19 of scrap material are introduced into furnace 20 by means of low vacuum interlock 23 which connects with entrance 24 of the furnace. The furnace includes outer shell 25 of insulating material such as silicon carbide material. Shield 26 formed from insulating material such as silicon carbide is in the form of joined stepped-cylinders and provides the structure of the furnace at entrance 24.

Scrap metal pellets or sponge metal pellets pass through entrance 24 into sleeve 27 disposed within shield 26. The sleeve may be constructed by graphite material in order to serve as an electrode which can withstand high temperature. The incoming scrap can be elevated in temperature by means of heaters 28 disposed within shield 26 and surrounding sleeve 27.

After the delivery of scrap pellets into sleeve 27, the pellets are held by stops 29 when the end portions **29*a* of the stops are disposed beneath the interior of the sleeve to an extent just sufficient to stop the pellets from falling but without blocking the path of plasma to bombard the bottommost pellet. The stops can comprise rollers formed from a temperature-resistant material such as silicon carbide or high temperature insulating material. Actuator 30 reciprocates stops 29 when the end portion of pellet 19 is melted down. Control 31 programs the operation of actuator 30 in order to maintain the end portion of pellet 19 at the appropriate position. The metal pellet which is preheated by heater 28** is bombarded by the plasma. When surface tension and thermodynamic equilibrium conditions are satisfied, a molten metal droplet is formed and falls from the pellet. The predetermined rate is controlled by the combination of preheating temperature and the cross-sectional area of the pellet facing the plasma bombardment current density. The feeding rate is selected according to the power input to the plasma and in response to the dwell time within the plasma which is required to effect refining of the scrap material.

In order to reduce the size and complexity of equipment for maintaining a vacuum condition in the furnace of the invention, entrance 24 can be maintained at an intermediate level of vacuum as compared to the remainder of the furnace. For example, the intermediate level of vacuum may be in the range of 10 to 100 mm.Hg. The intermediate level of vacuum is produced by vacuum source 32 which can comprise a vacuum pump connected to entrance 24 by line 33.

Below sleeve 27 and stops 29 there is disposed inner shell 34 which can be formed, for example, from graphite material in order to serve as an electrode and also in order to withstand high temperatures. Above inner shell 34 and surrounding shield 26 and sleeve 27 there is mounted annular electrode 35. This electrode can be provided with liquid cooling by means of coolant source 36 connected to passages **35*a* within the electrode, the connection being effected by line 37**. By way of example, the coolant may be water.

Beneath inner shell 34 there is disposed melting pot 38 which is formed of electrically-conductive material which is temperature-resistant, such as graphite material. The pot can be in the form of a comparatively shallow cylindrical structure open at its upper portion adjacent to inner shell 34. The pot receives refined molten metal within the furnace of the invention. The pot is provided with port 39 through which molten metal 66a can be released into mold 40. When the molten metal freezes, it forms mass 41 of metal. Valve 42 is adapted to close port 39 whenever it is intended to prevent a release of molten metal from melting pot 38. Actuator 43 controls valve 42.

The region of the furnace within outer shell 25 between shield 26 and bottom **25*a* of the outer shell is maintained at a high level of vacuum, for example, a vacuum condition within the range of about 1 to about 10 mm.Hg. The high level of vacuum is established and maintained by vacuum source 44. The vacuum source is connected to casing 45 which encloses the entire furnace and seals it from the atmosphere. Vacuum source 44 which may be a vacuum pump is connected to the casing by line 46**.

In order to reduce the volume of the furnace in which a high level of vacuum is to be maintained, the furnace can be provided with interlock 47 extending from bottom **45*a* of the casing of the outer shell and enclosing the region in which mold 40 is disposed. An intermediate level of vacuum is maintained in interlock 47 by means of vacuum source 48 which is connected to the interlock by line 48*a*. Mold 40 can be removed or installed through interlock 47** without interrupting the furnace operation. Thus the furnace can be operated to provide a continuous casting or smelting operation.

In accordance with the invention, the source of heat energy within the furnace comprises a direct current plasma 49 established between annular electrode 35 and inner shell 34. Direct current source 50 is connected by leads 51 and 52 to electrode 35 and inner shell 34. The positive side of the DC source is connected to electrode 35. Since a plasma is a highly ionized gas which is composed of nearly equal numbers of positive and negative free charges (positive ions and electrons), the furnace is provided with gas source 53 which is connected by means of a regulating valve 54 and line 55 to casing 45 of the furnace. The background gas for the plasmas supplied by source 53 is selected to be a gas having properties by which the gas can be easily ionized at a low ionization potential and a gas that is not readily absorbed by metal being melted within the furnace. The background gases can include inert gases such as argon and helium as well as nitrogen. A reactive gas can be mixed with background gas if it is intended to modify the properties of the metal being refined by the presence of the active gas. Reactive gases can be hydrogen for a direct-reduction process or high atomic number impurities for a catalyst. Gas source 53 can comprise pressured gas stored within a high pressure gas cylinder.

The furnace of the invention also contains an alternating current plasma 56 which is established between electrode or sleeve 27 and melting pot 38. Alternating current source 57 is connected by lead 58 to sleeve 27 and by lead 59 to the melting pot. Alternating current source can be commercial power source. The AC plasma is superimposed upon the DC plasma. AC and DC plasmas within the furnace are subjected to an externally applied magnetic field having lines of flux extending in an axial direction with respect to sleeve 27, inner shell 34 and melting pot 38. The axially extending magnetic field is provided by the flow of current from source 60 through windings 61 which are wound about the exterior casing 45. By way of example, the field strength can be in the range of about 150 gauss to about 1,000 gauss. In place of windings 61 rings of permanent magnetic material can be disposed about the casing to form an axial magnetic field.

In plasma physics the physical picture of a plasma can be divided into a microscopic picture and a macroscopic picture. The microscopic picture relates to the particle-like properties of the plasma such as the effects of particle collision which produce diffusion, ionization, X-ray radiation, etc. In the macroscopic picture of the plasma there can be seen the fluid-like properties of the plasma including electrical conduction, propagation of waves and the behavior of conducting fluids.

The charged particles of a plasma interact with each other through the electrostatic field with which each is surrounded. In the microscopic picture these electrostatic fields cause localized attractive or repulsive forces between the particles. In the macroscopic picture the summation of the microscopic electrostatic and magnetic fields of the particles produced by the moving plasma particles results in an average electromagnetic field. The plasma then reacts as a conducting fluid to the total electromagnetic field in which it is immersed. This field consists of the plasma electromagnetic field and any externally imposed field such as that resulting from windings 61.

Within the furnace of the invention the alternating current plasma 56 extending between sleeve 27 and melting pot 38 is superimposed upon the complete extent of direct current plasma 49 extending between electrode 35 and shell 34. The resulting magneto-plasma is produced by ionizing collisions of both the DC plasma electrons and the AC plasma electrons with the background gas. When the density ratio of the DC plasma to the AC plasma electrons is less than approximately $10^{-2}$, plasma production is dominated by the AC plasma electrons which are heated by dynamic friction resulting from the interaction with other particles in response to the applied magnetic field. The DC plasma is heated by R.F. fields resulting from the interaction of the AC plasma electrons and the DC plasma.

In order to maintain steady state operation of the furnace, the rate of production of ions and electrons of the plasmas must equal the rate of escape of these particles from the plasma. The strength of the plasma sheath is determined by the temperature of the plasma electrons and adjusts itself to give equal ion and electron current to the walls formed by casing 25. The loss rate of ions is equal to the ion saturation current density. The electron loss rate is determined by the distribution function and the plasma sheath potential and temperature. The rate of production can be calculated from a measured distribution function in conjunction with the ionization cross-section. For a steady equilibrium state to exist, the power and particle must be balanced simultaneously. The plasma dispersion relation in the presence of an applied magnetic field is completely different from that of a plasma without an applied magnetic field. For a weak magnetic field, the R.F. fields resulting from the interaction of the heated AC plasma electrons and DC plasma can be adjusted to be convective. The R.F. field is nearly uniformly distributed in the plasma column and the plasma is uniformly heated.

The AC power input is a parameter which is independent from the R.F. field and as a result the AC input power is a parameter which is independent from the plasma temperature.

The losses of the plasma are a direct function of plasma temperature. Since the power input and the particle balance have parameters independent of one another, increasing the power input alone can merely increase plasma production and not plasma temperature. Therefore, it is possible to adjust the parameters to cause the input power and particles to be balanced simultaneously to obtain a steady equilibrium state for the magneto-plasma. Thus the method of the invention for generating the magneto-plasma enables the power input and the plasma temperature to be controlled independently.

Figure 4A:
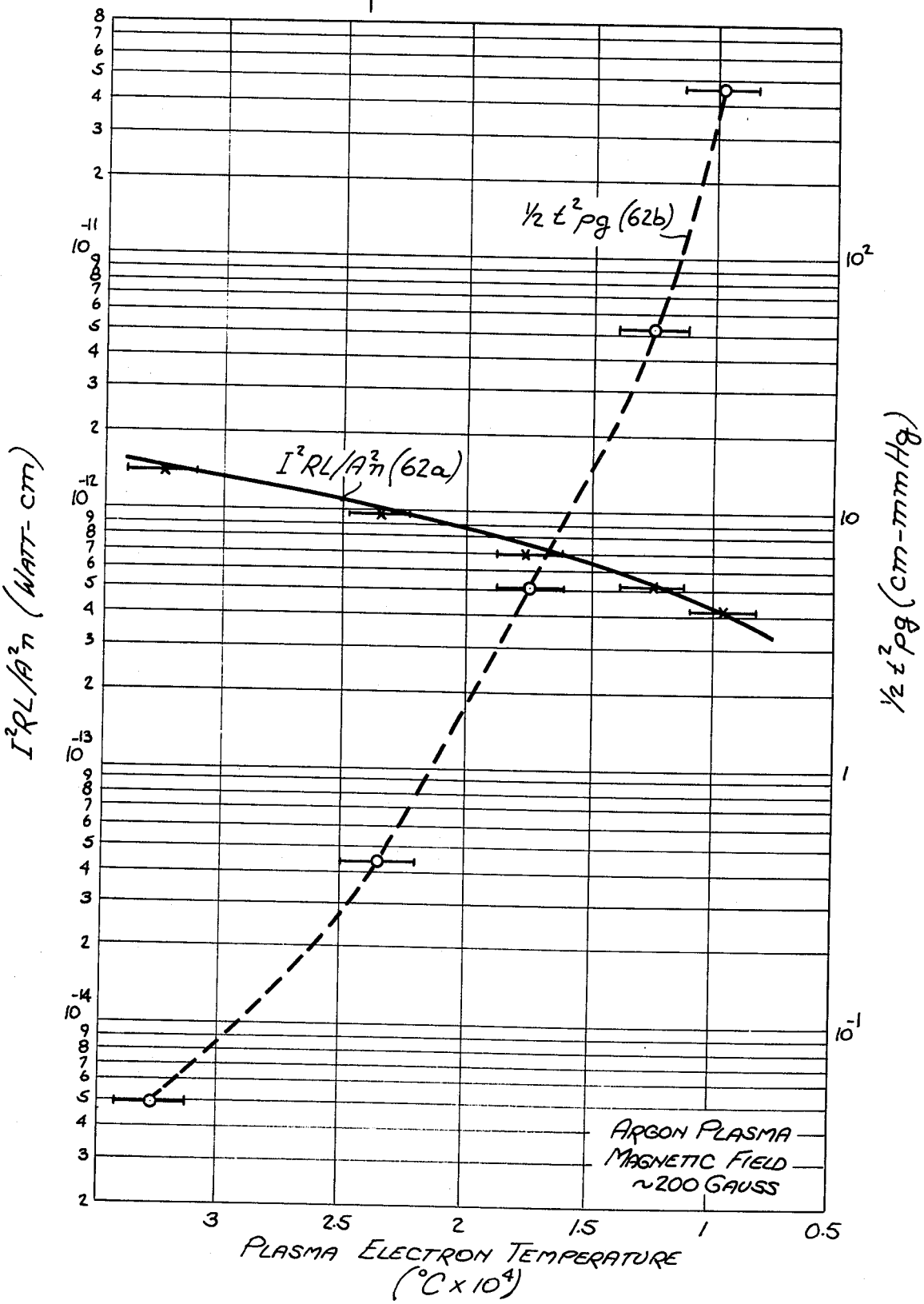
FIG. 4A is a graphical representation of the generalized operating conditions and designing parameters for a series of magneto-plasma furnaces of the invention where the plasma is an argon plasma.

FIG. 4A is a graphical representation of a generalized operating condition and designing parameters for a series of the magneto-plasma furnaces of the invention where the plasma is an argon plasma and the magnitude of the magnetic field vector of windings 61 is approximately 200 gauss.

In FIG. 4A curve 62*a* represents the parameter $I^2R$-$L/A^2n$ in watt-cm. plotted against the plasma electron temperature in degrees centigrade. In the parameter $I^2RL/A^2n$

- I is the alternating current delivered by AC source 57;
- R is the phenomenological resistivity of the magneto-plasma column;
- A is the cross sectional area of the magneto-plasma column;
- L is the length of the magneto-plasma column; and
- *n* is the electron density of the magneto-plasma.

Curve 62*b* in FIG. 4A represents the parameter $\frac{1}{2}$ $t^2pg$, where

- *t* is the time period needed for smelting and refining a predetermined molten metal descending from the lower portion of sleeve 27 to adjacent melting pot 38, that is to say, the time for molten metal to pass throughout the length of the magneto-plasma column.

$p$ is the initial vacuum condition of the furnace in mm. of Hg.; and $g$ represents the acceleration of gravity.

The parameters of FIG. 4A is expressed by curves 62*a* and 62*b* plotted against plasma electron temperature have been empirically derived, for a given background gas, argon, and for a predetermined magnetic field vector, by way of example, approximately 200 gauss.

The use of the parameters of FIG. 4A can be shown by way of Example 1 as set forth below. The example is that of a magneto-plasma furnace for recycling contaminated steel scrap separated from municipal solid-waste material. The designed nominal capacity of the furnace is selected to be in the range of approximately two to approximately six tons per hour of steel material or stainless steel semi-finished products (commercial grades).

In the furnace of the example, the axial magnetic field is approximately 200 gauss; however in practice, it can be between approximately 150 to approximately 1000 gauss. The axial field can readily be defined by the power input to the field producing winding 61. The formula for the solenoid winding is $B = \mu iN$ where $\mu$ is $4\pi \times 10^{-7}$ weber/amp.-meter;

$i$ is current in amperes; and

N is the number of turns per unit length.

The field does not depend on the diameter or length of the solenoid winding 61. The field is constant over the solenoid cross section.

In the furnace of the example, $B = (4\pi \times 10^{-7}$ weber-/amp-m) (40 amp) 4 layer × 100 turns/meter)

$= 200.96 \times 10^{-4}$ weber/meter$^2$ $= 200.96$ gauss

The power input to winding 61 is dependent upon the design of the winding and can vary for a given axial field strength. It should be noted that the total power input is negligible compared to the power consumed in the plasmas.

The power input to the preheating stage 28 is determined by the temperature level to be reached by preheating, which for example can be approximately 300° C. Since different metal materials have different specific heats, to heat to the preheating temperature requires different power per unit weight for different materials. The power for preheating is only a small portion of total power consumption.

In the furnace of Example 1, shell 34 has an inside diameter of approximately 8 feet;

the overall inside height of the furnace is approximately 30 feet;

the preheating temperature of scrap metal pellets 19 is in the range of about 300° C;

the feeding rate of the metal pellets is approximately 6% over the nominal furnace capacity in tons per hour; the background gas is argon;

the initial vacuum condition, p, is 1 mm.Hg. absolute; the background gas pressure fluctuations during operation are in the range of about 1 to 10 mm.Hg. absolute; the applied axial magnetic field vector is approximately 200 gauss;

the applied DC voltage is in the range of 40 to 1000 volts;

the applied DC current is in the range of 90 to 100 amperes for the DC plasma;

material is contaminated steel or aluminum scrap separated from municipal refuse; and the product is commercial grade ingot.

EXAMPLE 1

The smelting time period for a predetermined molten metal droplet of the preselected metal material has been experimentally determined to be approximately 0.45 second. The distance through which the molten metal droplet can fall in 0.45 second is calculated by $L = \frac{1}{2} gt^2$ which gives a distance of 98 cm., the length of the required magneto-plasma column for the furnace of the invention.

The initial vacuum condition is selected to be 1 mm.Hg. The parameter of cruve 62*b*, that is $\frac{1}{2} t^2pg$, gives the result of 98 cm.-mm.Hg. for the selected distance and pressure conditions. The value of 98 cm.-mm.Hg. when selected along curve 62*b* shows the corresponding plasma electron temperature on the horizontal axis of FIG. 4A to be 11,500° C.

The plasma electron temperature determined by curve 62*b* defines a point along curve 62*a* which is $5.2 \times 10^{-13}$ watt-cm. The optimum cross sectional area of the magneto-plasma column, that is term A, is selected in the example to be 180 cm.$^2$. The maximum attainable plasma electron density, $n$, is $3.3 \times 10^{16}$ per cm$^3$. With the values of A and n for the selected example, the parameter $I^2RL/A^2n$ can be rewritten as $$I^2RL/A = 5.2 \times 10^{-13} \times A \times n = 5.2 \times 10^{-13} \times 180 \times 3.3 \times 10^{16}$$

which = 3088 KW. The value 3088 KW is the maximum average power capacity of the furnace of the example.

It is known that the average electrical energy requirement for refining and smelting steel material is approximately 500 KWH per ton of material. With the determined maximum average power capacity of the furnace in the example of 3088 KW, it can be seen that with an energy requirement of 500 KWH per ton, the maximum tonnage capacity of the furnace of the example is 6.17 tons of steel per hour.

The capacity of the furnace in tons per hour can be adjusted without disturbing the stable operating condition of the plasma by varying the plasma electron density $n$. (One way to vary the plasma electron density is to change applied current.) Thus, in the example, the capacity can be adjusted from approximately 2 tons to approximately 6 tons per hour.

If a predetermined scrap material is to be refined within the furnace of the invention, experiments can be conducted to determine the predetermined time period which is needed for smelting and refining the material in the magneto-plasma. The plasma electron temperature necessary for refining the metal material during the predetermined time period can readily be calculated. Plasma electron temperature values are represented along the horizontal axis of the graph. In utilizing the graph or plot 62, the plasma electron temperature value determines a point on curve 62*a* which represents the required input power of $I^2RL/A^2n$ as represented along the lefthand vertical axis of the plot.

The rate of feeding the scrap metal pellet material by means of stops 29 can be determined from the relationship of $I^2RL/AE \times$ efficiency, where the term E represents the total energy per unit weight of material which is required for conducting the smelting process in the magneto-plasma furnace of the invention. Conversely, the length L of the plasma column can be adjusted in accordance with the input power relationship. In this way, the time period for smelting by means of the process of the invention can be controlled.

Another embodiment of the furnace of the invention is set forth immediately below. This furnace is operated in accordance with the conditions derived below under EXAMPLE 2.

In the furnace, to be operated in accordance with Example 2, inner shell 34 has an inside diameter of approximately 20 feet;

the overall inside height of the furnace is approximately 35 feet;

the preheating temperature of scrap metal pellets 19 is in the range of about 300° C.;

the feeding rate of the metal pellets is approximately 6% over the nominal furnace capacity in tons per hour;

the background gas is helium;

the initial vacuum condition, *p*, is 1 mm.Hg. absolute;

the background gas pressure fluctuations during operation are in the range of about 1to 10 mm. absolute;

tha applied axial magnetic field vector is approximately 200 gauss;

the applied DC voltage is in the range of 40 to 1000 volts; and the applied DC current is the range of 1500 amperes for the DC plasma;

the raw material is contaminated steel or aluminum scrap separated from municipal refuse; and the output product is commercial grade ingot.

EXAMPLE 2

The smelting time period for a molten metal drople of steel or aluminum has been experimentally determined to be approximately 0.45 seconds. The distance through which the molten metal droplet can fall in 0.45 seconds is calculated by $L=\frac{1}{2} gt^2$ which gives a distance of 98 cm. This distance is the required length of the magneto-plasma column for the furnace of the invention.

The initial vacuum condition is selected to be 1 mm. Hg. The parameter of curve 62*b''* of FIG. 4C, that is ½ *t* pg, gives the result of 98 cm.-mm.Hg. for the selected distance and pressure conditions.

Figure 4B:
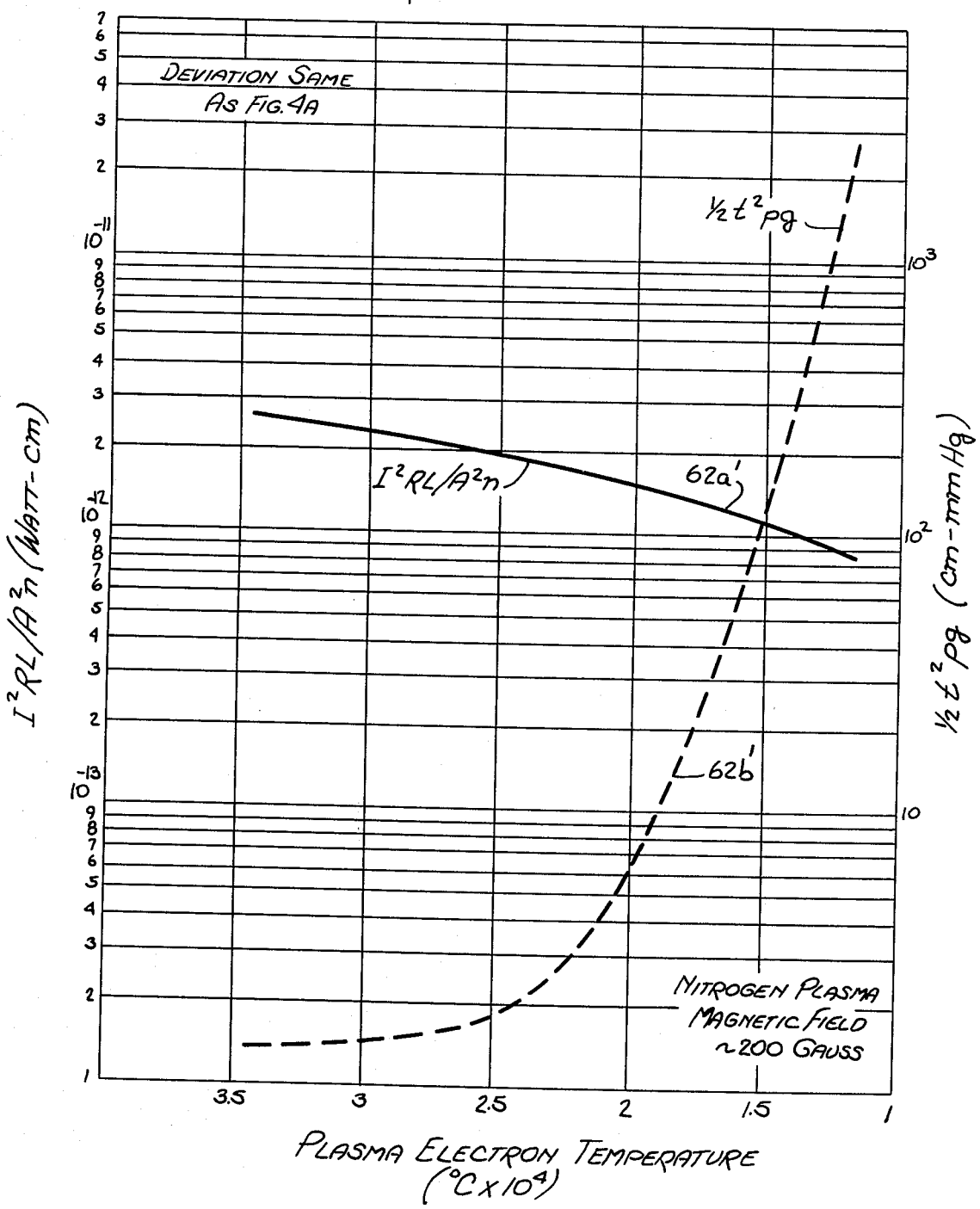
FIG. 4B is a graphical representation of the generalized operating conditions and designing parameters for a series of magneto-plasma furnaces of the invention where the plasma is nitrogen plasma.
Figure 4C:
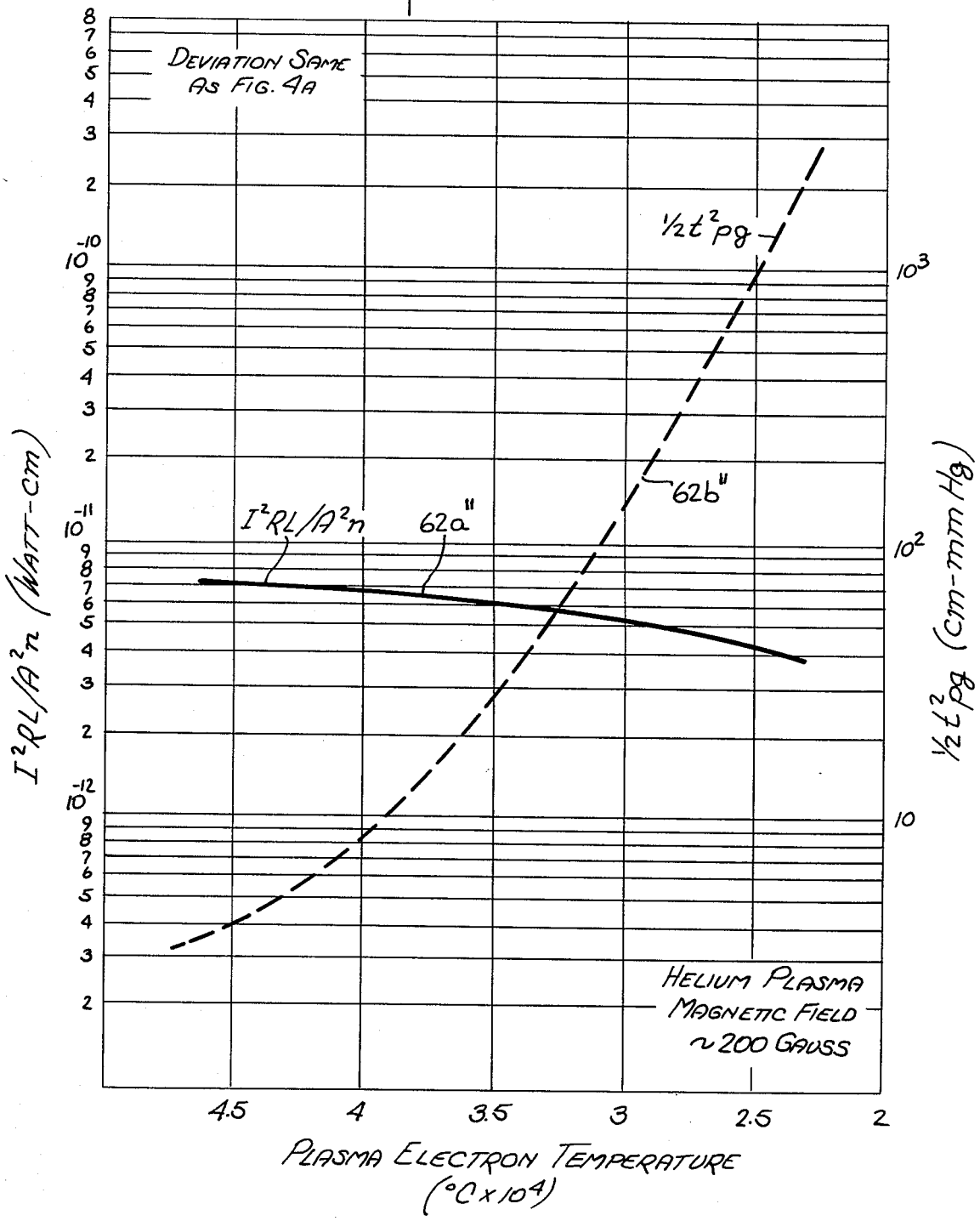
FIG. 4C is a graphical representation of the generalized operating conditions and designing parameters for a series of magneto-plasma furnaces of the invention where the plasma is helium plasma.

The value of 98 cm.-mm.Hg. when selected along curve 62*b''* of FIG. 4C shows that the corresponding plasma electron temperature on the horizontal axis to be 31,000° C.

The plasma electron temperature of 31,000° C. determined by curve 62*b''* defines a point along curve 62*a''* of FIG. 4C which is $5.4 \times 10^{-12}$ watt-cm.

The optimum cross-sectional area of the magneto-plasma column, that is term A, is selected in Example 2 to be 2,920 $cm^2$. The maximum attainable plasma electron density, *n*, is $3.3 \times 10^{16}$ per $cm^3$. With the values of A and n for the selected example, the parameter $I^2R$-$L/A^2n$ can be rewritten as $$I^2RL/A = 5.4 \times 10^{-12} \times A \times n = 5.4 \times 10^{-12} \times 0\ 2920 \times 3.3 \times 10^{-16} = 520{,}344{,}000 \text{ Watts} = 520{,}344 \text{ KW}$$

The value 520,344 KW is the maximum average power capacity of the furnace of the invention to be operated in accordance with EXAMPLE 2.

If EXAMPLE 2 is taken as smelting steel material, again it is known that the average electrical energy requirement for refining and smelting steel material is approximately 500 KWH per ton of material. With the determined maximum average power capacity of the furnace in EXAMPLE 2 of 520,344 KW, it can be seen that with an energy requirement of 500 KWH per ton, the maximum tonnage capacity of the furnace of EXAMPLE 2 is 1,040,68 tons of steel per hour.

The capacity of the furnace in tons per hour can be adjusted without disturbing the stable operating condition of the plasma by varying the plasma electron density n since n is a variable of curve 62*a''* which is a parameter of stable operating condition. One way to vary the plasma electron density is to change applied current. Thus, in the example, the capacity of the furnace can be adjusted from approximately 500 tons per hour to approximately 1000 tons per hour.

EXAMPLE 2 clearly illustrates that for larger furnaces, it is economical to use helium plasma in accordance with the parameters of FIG. 4C.

Another embodiment of the furnace of the invention as set forth below can be operated in accordance with the conditions derived in EXAMPLE 3. The furnace of this embodiment is adopted to smelt austenitic stainless steel.

The other dimensions of the furnace of this embodiment are the same as those of the furnace operated in accordance with EXAMPLE 1. The same is true for the furnace operating values of vacuum condition, background gas pressure, the axial magnetic field vector and the applied voltage and current for the DC plasma. In this embodiment, the background gas is nitrogen.

EXAMPLE 3

Since it is a requirement of stainless steel to maintain a low carbon content, for example 0.08 to 0.15 percent, the smelting time period for a predetermined molten metal droplet of stainless steel material has been experimentally determined to be approximately 0.65 seconds. The distance through which the molten metal droplet can fall in 0.65 seconds is calculated by $L=\frac{1}{2} gt^2$ which gives a distance of 206 cm., the length of the required magneto-plasma column for this embodiment of the furnace of the invention.

The initial vacuum condition is selected to be 1 mm.Hg. The parameter of curve 62*b'* of FIG. 4B, that is ½ $t^2$ pg, gives the result of 206 cm-mm.Hg. for the selected distance and pressure conditions.

The value of 206 cm-mm.Hg. when selected along curve 62*b'* of FIG. 4B shows that the corresponding plasma electron temperature of the horizontal axis of FIG. 4B to be 14,500° C.

The plasma electron temperature determined by curve 62*b'* of FIG. 4B defines a point along curve 62*a'* which is equal to $1.1 \times 10^{-12}$ watt-cm.

The optimum cross sectional area of the magneto-plasma column, that is term A, is selected in the example to be 180 $cm^2$. The maximum attainable plasma electron density, *n*, is $3.3 \times 10^{16}$ per $cm^3$. With the value of A and *n* for the selected example, the parameter $I^2RL/A^2n$ can be rewritten as $$I^2RL/A = 1.1 \times 10^{-12} \times A \times n = 1.1 \times 10^{-12} \times 180 \times 3.3 \times 10^{16} = 6{,}534{,}000 \text{ watts} = 6{,}534 \text{ KW}$$

The value 6534 KW is the maximum average power capacity of the embodiment of the furnace of the invention which is to operate in accordance with the condition of EXAMPLE 3.

Since to introduce alloying agents into the refined molten metal does not consume power, the average electrical energy requirement for refining and smelting stainless steel is still approximately 500 KWH per ton of material. With the determined maximum average power capacity of the furnace for EXAMPLE 2 of 6534 KW, it can be seen that with an energy requirement of 500 KWH per ton, the maximum tonnage capacity of the furnace of the example is 13.06 tons of stainless steel per hour.

The examples set forth herein are simply illustrations of a plurality of embodiment of the furnace of the invention and are not intended to be restrictive. Thus the furnace of the invention is not limited to the background gases of the examples, the dimensions of the embodiment, or the operating conditions including those of the example.

It should be noted that the parameters of FIGS. 4D, 4B and 4C enable the design of a furnace to be determined in the manner taught by the examples. Thus the same parameters of these figures can be used to design a family of different capacity furnaces in accordance with the invention with a range of different operating conditions.

Measurements of the resistivity of the magneto-plasms show that the slop of the volt-ampere characteristic is a positive one. The positive slope is though to be directly related to the power and particle balance mechanism which serves as an intrinsic feed-back mechanism for stabilizing the resistive characteristics. The provision of an AC plasma upon a DC plasma in the presence of an axial magnetic field surrounding the plasma contributes to the advantages positive slope. As a result, the magneto-plasma does not have large voltage fluctuations and it is not sensitive to pressure variations resulting from the emission of evaporated materials which contaminate the scrap material being refined.

The axial magnetic field resulting from the flow of current through windings 61 causes the plasma electrons which are being generally lost to transfer their energy to the upper and lower end portions of the furnace, that is to say metal pellet 19 and molten metal **66*a* in melting pot 38, since the a.c. plasma does not contact shell 34 and the wall of melting pot 38 by following the lines of the axial magnetic field. As a result, the plasma column which is substantially in the form of a straight cylinder can be adjusted in length from a few centimeters to a few meters. The inner surface or walls of outer shell 25** reflect most of the radiation energy back to a plasma. This enables a high level of power utilization efficiency to be obtained.

Thus it can be seen that the stable magneto-plasma used in accordance with the invention is not limited in length and that both the power input level and the plasma temperature can be controlled independently of one another. These characteristics make it possible to carry out a metallurgical smelting process for contaminated metals in accordance with the teaching of the invention.

Figure 6:
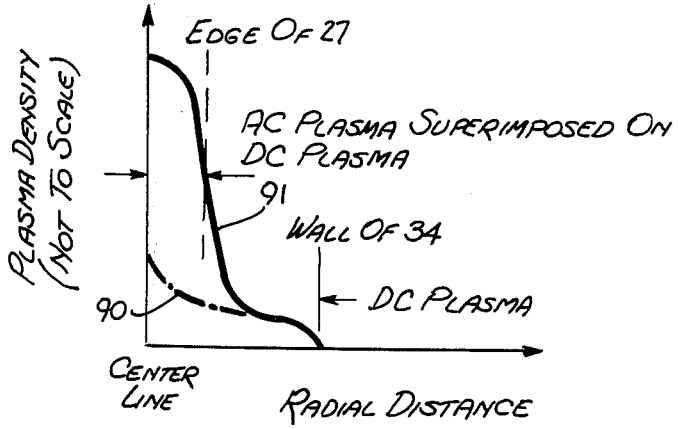
FIG. 6 is a graphical representation of the plasma density plotted against the radial distance from the center of the plasma.

As shown in FIG. 6, the plasma density varies in a radial direction extending outwardly from the longitudinal centerline of the furnace toward shell 34 of the furnace. Curve 90 represents the plasma density of the D.C. plasma which decreases with a substantially moderate slope from the furnace center line toward shell 34. Curve 91 shows the density of the A.C. plasma superimposed upon the D.C. plasma. Since the A.C. plasma is confined to the central core of the furnace within the D.C. plasma it can be seen by way of Curve 91 that the density of the A.C. plasma superimposed on the D.C. plasma is maximum in the central core of the furnace in line with sleeve electrode 27 and then decreases abruptly. Thus it can be seen that the region of maximum plasma density is the central plasma column where the refining and smelting of the molten metal droplets occurs.

The parameters of FIGS. 4A, 4B, and 4C which contains curves **62*a* and 62*b*** representing the empirical operating conditions of the invention can serve as a useful guide for establishing the proper operating conditions with regard to the power requirements and the magneto-plasma local temperature in terms of the metal smelting and refining rate for specified magneto-plasma column dimensions. Since the operating conditions can be analyzed, it becomes possible to provide programming for control.

The preheated metal pellet is bombarded and heated by the plasma. As soon as the surface tension and thermodynamic equilibrium conditions are satisfied a molten metal droplet is formed which falls from the pellet which is through the stops 29 and into the magneto-plasma of the invention which can have a local temperature, for example, in the range of about 10,000° C. When the molten metal droplet is descending, similar molecules stay together, due to the surface tension and self-adhesion. As a result, the majority segregate the minority, and the contaminating material is diffused into the surface of the droplet. Plasma sheath 65 surrounding the molten metal droplets 66 is instantaneously formed. When a local plasma potential is imposed upon a molten metal droplet 66, the droplet is subjected to local heating and the contaminations diffused into the surface of the droplet are then bombarded intensely by both electrons and ions. In this manner, contaminating material is removed from the molten droplets during their transit for a finite period of time through the plasma. Droplets 66 are thereby made free of chemical and physical contaminating materials.

Alloy material can be introduced into the molten metal disposed in melting pot 38. Alloy materials are provided to the furnace by means of dispenser 67 which is connected by line 68 to the interior of the melting pot. Controller 69 actuates dispenser 67 in order to deliver a predetermined quantity of alloy elements to the melting pot. In some cases, alloy elements may be added to the pellets of material being refined within the furnace by placing the alloy elements in the scrap metal pellets prior to their processing in the furnace.

The purity of the molten metal **66*a* being refined can be instantaneously and continuously monitored by spectroscopic methods. The advantage of spectroscopic methods is that they result in negligible interference with the plasma during the process of optical measurement. In order to provide a view of the plasma and the molten metal particles adjacent melting pot 38, there is provided tube 70 which extends through casing 45 of the furnace and outer shell 25 disposed therein. End portion 70*a* of the tube is disposed adjacent to the upper surface of melting pot 38. Window 71 enables radiation to be transmitted through the tube and outwardly while maintaining the vacuum level within outer shell 25. Lens system 72 directs and focuses the radiation from window 71 upon the radiation receiving portion of spectrum analyzer 73. With this arrangement the emission spectra received adjacent to the refined metal 66*a*** can be analyzed to determine the constituents of the molten metal. The information obtained from the spectrum analyzer enables the furnace to be controlled to obtain the desired degree of refining of the metal. FIG. 6 shows plasma density of the superimposed A.C. plasmas as well as the D.C. plasma plotted against the radial distance from the center of the plasma column.

Figure 5:
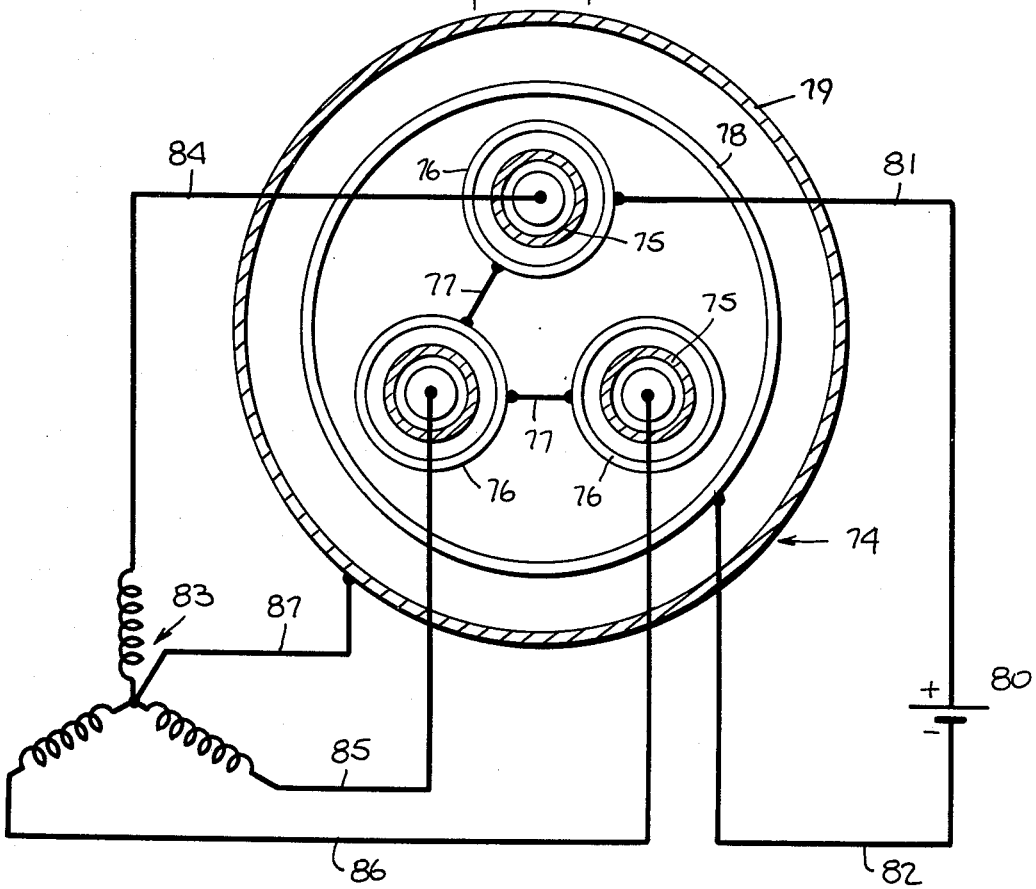
FIG. 5 is a schematic representation of the furnace of the invention containing a plasma generated from a polyphase alternating current source.

FIG. 5 is a schematic representation of the furnace of the invention when adapted to operate with a polyphase source of alternating current. Furnace 74 as shown in the horizontal section of the schematic representation of FIG. 5 includes sleeves 75 for receiving the scrap metal pellets to be refined and for forming the upper electrode of the A.C. plasma. Annular electrodes 76 surrounding sleeves 75 are commonly connected by leads 77. Inner shell 78 encloses each of the assemblies of sleeves 75 and annular electrodes 76. Melting pot 79 is disposed beneath the lower portion of inner shell 78.

Direct current source 80 is connected by leads 81 and 82 to one of annular electrodes 76 and to inner shell 78, respectively. Lead 81 is connected to the positive side of the D.C. source 80 and thus places a positive potential upon each of the annular electrodes 76.

Source 83 of polyphase A.C. current is connected by leads 84, 85 and 86 to each of sleeves 75. The neutral or center point of the polyphase source 83 is connected by lead 87 to melting pot 79.

The arrangement of furnace 74 operates in a manner similar as that described for furnace 20 in FIGS. 2 and 3. Thus a D.C. plasma is formed between annular electrodes 76 and inner shell 78. At the same time an A.C. plasma is established between each of sleeves 75 and melting pot 79. As in furnace 20, the A.C. plasma is superimposed upon the D.C. plasma in furnace 74.

As shown in FIGS. 2 and 3, furnace 20 can be provided with surface 88 extending between inner shell 25 and casing 45. Surface 88 can be provided with cooling coils 89 which receive a flow of coolant from source 90. Surface 88 enables vapor within the furnace produced from contaminants on the metal material being refined to be condensed and retained upon the surface for periodic removal.

The furnace of the invention can operate in a continuous mode since the pellets 19 cooperate with sleeve 27 in maintaining electrical continuity between the positive side of A.C. source 57 and the bottommost pellet which is subjected to the superimposed plasmas. The pellets within sleeve 27 are in electrical contact with the inner surface of sleeve 27. In addition, the upper face of one pellet is in contact with the lower face of the pellet above. There is a heavy flow of current not only from the sleeve to the bottommost pellet being subjected to the plasmas but also from the sleeve, through the pellets, and to the bottommost pellet. Since the pellets have an irregular surface, the flow of current from the face of one pellet to that of another occurs at a plurality of small contact points. At these contact points the current density is sufficient to raise the pellet material to a fusion temperature with the result that the pellets became welded to one another. As a result, the pellets within sleeve 27 are welded into a continuous body of pellet material which is metered into the plasmas by the action of rollers 29. Accordingly, the sleeve enables the pellets to be delivered as if the pellets were a portion of a continuous member being fed into the furnace of the invention.

OPERATION

Scrap metal pellets 19 are transmitted through interlock 23 into sleeve 27. Heaters 28 enable the pellets to be elevated in temperature prior to the refining process. The region enclosed by the interlock and shield 26 surrounding sleeve 27 is maintained at an intermediate vacuum level by vacuum source 32.

After the delivery of scrap metal pellets into sleeve 27, stops 29 block the pellets from falling as the end portions **29*a* of the stops are disposed beneath the interior of the sleeve just sufficiently to stop the metal pellet from falling but allowing the plasma to bombard the preheated pellet 19. When the surface tension and thermodynamic equilibrium conditions are satisfied, the molten metal droplet 66 is formed and falls from the pellet through the stops 29. Each molten metal droplet descends into the magneto-plasma column which is formed within the furnace by AC plasma 56 superimposed upon DC plasma 49. The AC plasma extends between sleeve 27 and melting pot 39. The DC plasma extends between annular electrode 35 and inner shell 34.**

Due to the high temperature within the magneto-plasma, for example a temperature in the range of approximately 10,000° K, and the vacuum environment in the furnace, for example in the range of 1–10 mm.Hg., all surface of the pellet are freed of contaminating materials by evaporationg and sputtering.

The molten metal droplet is a good conductor. When it remains inside of the plasma, a floating potential is automatically imposed upon the surface of the metal droplet. A plasma sheath is instantaneously formed in a few Debye lengths ($10^{-3}$ cm). away from the surface of the metal droplet. The potential difference between the floating potential on the surface of the metal droplet and the plasma potential on the plasma sheath of the metal droplet creates a strong electric field which is established radially (for example $10^4$ volts/cm.). with the axial magnetic field and collision effects, an equal ion and electron current bombard the surface of the metal droplet.

Most electrons penetrating into the material are completely decelerated afer passing through a layer of a few microns thickness. Practically all their high kinetic energy is converted into heat which causes the local temperature to be raised much higher than the melting temperature. This high temperature causes the metallurgical phase equilibrium to be broken down, so that the smelting process may be performed according to diffusion kinetics, surface tension and metal chracteristics. Thus the smelting method of the invention comprises a metallurgical operation in which metal is separated by fusion from the impurities with which it may be chemically combined or physically mixed.

Since the externally applied axial magnetic field interacts with the radial electric field, a rotational motion of the plasma around the annular perimeter of the molten metal droplet occurs. The rotational motion enhances the diffusion kinetics.

Special high temperature slage separation process can be performed by adding small amounts of catalytic reactive gas into the plasma background gas. After the smelting process of the invention is performed by use of the magneto-plasma, all the contaminations can be removed. If desired, an alloying process then can follow.

During operation the condition of the molten metal 66*a* is examined by means of spectrum analyzer 73 which receives emissions from the plasma and of excited states of metal molecules in the vicinity of the molten metal 66*a* transmitted through tube 70, window 71 and lens system 72. Upon monitoring the measurements obtained by spectrum analyzer 73, if it is desired to introduce alloying agents into the refined molten metal being accumulated in melting pot 38, dispenser 67 can be actuated to deliver the agents by means of line 68 extending to the upper portion of the melting pot. The power input is related to the rate of delivery of pellets 19. The curve 62*a* and 62*b* of plot 62 in FIG. 4 determine the operating conditions as well as the feeding speed of pellets into sleeve 27.

When a quantity of molten metal has been accumulated in melting pot 38, actuator 43 opens valve 42 and releases a quantity of molten metal into mold 40. Subsequently the mold can be removed from vacuum interlock 47 by means of door 47*a*.

What is claimed is:

1. A method for smelting and refining metal material comprising the steps of:

a. establishing a predetermined high level vacuum condition within the interior of an enclosure;

b. establishing a level of background gas within the interior of the enclosure;

c. applying a direct current potential to a pair of electrode spaced apart from one another along the length of the enclosure to form a direct current plasma extending adjacent the electrodes;

d. applying an alternating current potential to a pair of electrodes disposed along the length of the enclosure to form an alternating current plasma extending adjacent the electrodes, the alternating current plasma being formed at a location within the enclosure to superimpose the alternating current plasma upon the direct current plasma to stablize the alternating current plasma;

e. placing the metal material within the alternating current plasma superimposed upon the direct current plasma, the metal material being melted into droplets and having impurities to be refined therefrom removed from the droplets in response to the elevated temperature of the plasma, the bombardment of the plasma and the high level vacuum condition within the enclosure; and f. collecting the refined molten drops of metal.

2. A method in accordance with claim 1 for refining metal material in which the step of placing metal material within the plasmas comprises the steps of delivering metal material to the enclosure and metering a release of metal material into the plasma.

3. A method in accordance with claim 2 for refining metal material in which the step of delivering metal material to the enclosure comprises the step of delivering pellets of metal material and in which the step of metering comprises the step of sequentially releasing the pellets in a predetermined rate corresponding to the rate at which metal material is to be refined.

4. A method in accordance with claim 1 for refining metal material in which the step of applying potentials to form alternating current plasma superimposed upon a direct current plasa comprise the steps of forming substantially vertically extending plasmas and in which the step of placing metal material in the plasmas comprises the step of placing the metal material in the upper portion of the plasmas to enable the metal material to descend through the plasmas in response to the gravitation field.

5. A method in accordance with claim 1 for refining metal material and further comprising the step of preheating the metal material to an elevated temperature prior to the step of placing the metal material in the plasmas, the step of preheating the metal material enabling the metal material to reach the evaporation temperature of surface contaminations, thereby enabling the contaminations to be pumped out before melting in a reduced amount of time after the metal material is placed in the plasmas.

6. A method in accordance with claim 1 for refining metal material in which the step of placing metal material into the plasmas comprises the steps of advancing the metal material to be refined into a chamber adapted to be in communication with the interior of the enclosure, producing an intermediate level vacuum condition within the chamber, and delivering the metal material from the chamber into the enclosure and the plasmas therein, the intermediate level vacuum condition in the chamber facilitating the maintenance of the predetermined high level vacuum condition within the interior of the enclosures.

7. A method in accordance with claim 1 for refining metal material and further comprising the step of applying a magnetic field to the alternating current plasma superimosed upon the direct current plasma to enhance the plasmas, the magnetic field substantially enclosing the plasmas and extending in the direction along which the plasmas extend, the plasmas when subjected to the magnetic field having a positive voltage characteristic with respect to current.

* * * * *

UNITED STATES PATENT OFFICE

CERTIFICATE OF CORRECTION

Patent No. 3,944,412 Dated March 16, 1976

Inventor(s) Hsin Liu

It is certified that error appears in the above-identified patent and that said Letters Patent are hereby corrected as shown below:

Abstract second col. line 19 "th" should be --the--.

Col. 9, line 4, "is" should be --as--.

Col. 9, line 49 "shell 34" should be --inner shell 34--.

Col. 9, line 13, "cruve" should be --curve--.

Col. 11, line 21, "1 to 10 mm." should be --1 to 10 mm.Hg.--.

Col. 12, line 4, "1,040,68" should be --1,040.68--.

Col. 13, line 4, "Example 2" should be -- Example 3--.

Col. 13, line 24 "plasms" shocld be --plasma--.

Col. 13, line 25 "though" should be --thought--.

Col. 13, line 31 "plasma" should be --plasmas--.

Col. 16, line 21 "pot 39" should be --pot 38--.

Claim 1 (c) line 28, "electrode" should be --electrodes--.

Signed and Sealed this

Third Day of August 1976

[SEAL]

*Attest:*

RUTH C. MASON
*Attesting Officer*

C. MARSHALL DANN
*Commissioner of Patents and Trademarks*